US008002125B2

(12) United States Patent
Van Wyk

(10) Patent No.: US 8,002,125 B2
(45) Date of Patent: Aug. 23, 2011

(54) MOTORCYCLE ACCESSORY RACK

(75) Inventor: Loren D. Van Wyk, Pella, IA (US)

(73) Assignee: Loren D. Van Wyk, Pella, IA (US)

( * ) Notice: Subject to any disclaimer, the term of this patent is extended or adjusted under 35 U.S.C. 154(b) by 176 days.

(21) Appl. No.: 12/322,563

(22) Filed: Feb. 4, 2009

(65) Prior Publication Data

US 2010/0059464 A1 Mar. 11, 2010

Related U.S. Application Data

(63) Continuation-in-part of application No. 12/283,343, filed on Sep. 11, 2008.

(51) Int. Cl.
*A47F 7/00* (2006.01)

(52) U.S. Cl. ..... 211/85.7; 211/175; 211/41.14; 296/78.1; 296/37.1

(58) Field of Classification Search ..... 211/85.7, 211/85.3, 90.01–90.04, 30, 32, 183, 106, 211/181.1, 13.1, 189, 41.14, 175; 296/78.1, 296/96.21; 248/240
See application file for complete search history.

(56) References Cited

U.S. PATENT DOCUMENTS

| | | | | | |
|---|---|---|---|---|---|
| 1,171,198 | A | * | 2/1916 | Hellberg | 248/223.21 |
| 2,525,259 | A | * | 10/1950 | August | 211/85.3 |
| 4,854,456 | A | * | 8/1989 | Lee | 211/14 |
| 4,936,467 | A | * | 6/1990 | Bobeczko | 211/14 |
| D309,998 | S | * | 8/1990 | Sumrell et al. | D6/567 |
| 5,228,578 | A | * | 7/1993 | Wu | 211/43 |
| 5,871,105 | A | * | 2/1999 | Whitehead et al. | 211/14 |
| 6,112,909 | A | * | 9/2000 | Moseley | 211/32 |
| D431,954 | S | * | 10/2000 | White | D6/630 |
| D439,465 | S | * | 3/2001 | Mok | D6/630 |
| 6,257,425 | B1 | * | 7/2001 | Liu | 211/90.01 |
| D450,199 | S | * | 11/2001 | White | D6/407 |
| 6,679,537 | B1 | * | 1/2004 | Putnam, Jr. | 296/78.1 |
| 6,808,219 | B2 | * | 10/2004 | Barber et al. | 296/78.1 |
| 6,820,756 | B2 | | 11/2004 | Garza | |
| 6,892,992 | B2 | * | 5/2005 | Donahue | 248/201 |
| 7,150,364 | B2 | * | 12/2006 | Jablow et al. | 211/153 |
| 7,168,577 | B1 | * | 1/2007 | Moseley | 211/32 |
| 2003/0052031 | A1 | | 3/2003 | Poore | |
| 2003/0218109 | A1 | * | 11/2003 | Farnham | 248/205.1 |
| 2004/0124161 | A1 | * | 7/2004 | Lau | 211/40 |
| 2004/0124165 | A1 | * | 7/2004 | Miller et al. | 211/153 |

* cited by examiner

*Primary Examiner* — Darnell Jayne
*Assistant Examiner* — Devin Barnett
(74) *Attorney, Agent, or Firm* — Brick Gentry P.C.; Brian J. Laurenzo; Bradley W. Thies

(57) ABSTRACT

A motorcycle accessory rack is provided which includes spaced-apart first and second brackets having a plurality of support rods secured thereto and extending therebetween. The first and second brackets may be secured to a supporting surface such as a wall or the like. The rods may be moved in their respective slots or openings or moved to different slots or openings to accommodate accessories from different models of motorcycles. Optional helmet hangers and jacket hangers are also provided at the sides of the rack. A pair of upright supports are mounted on a pair of support rods and are adapted to have a motorcycle windshield clamped thereonto.

7 Claims, 11 Drawing Sheets

MOTORCYCLE ACCESSORY RACK

CROSS REFERENCE TO RELATED APPLICATION

This is a continuation-in-part application of pending application Ser. No. 12/283,343 filed Sep. 11, 2008 entitled A MOTORCYCLE ACCESSORY RACK.

BACKGROUND OF THE INVENTION

1. Field of the Invention

The co-pending application relates to a motorcycle accessory rack and more particularly to a mounted motorcycle accessory wall rack having adjustable mounting points to accommodate different motorcycle accessories such as a windshield, rider backrest, passenger backrest, luggage rack or tour pack. More particularly, this application relates to a motorcycle accessory rack which enables a new style(s) of detachable windshields of Harley-Davidson® to be attached thereto.

2. Description of the Related Art

Late model motorcycles such as Harley-Davidson® have accessories for the motorcycle such as a detachable windshield, a rider backrest, a passenger backrest, a luggage rack or a tour pack, which may be detachably secured to the motorcycle or selectively removed therefrom. When the accessories are removed from the motorcycle, it is convenient to have a rack upon which the accessories may be stored. Harley-Davidson® builds many different types of motorcycles and most of those models use different means or methods of mounting their detachable hardware. All of the prior art mounting racks, of which Applicant is aware, are built for only accessories from one model or family of Harley-Davidson® motorcycles. For example, if a consumer has a Harley-Davidson Softail® and wall rack for those accessories and then purchases or trades that motorcycle in on a Harley-Davidson® Touring model, the wall rack the consumer owned for the Softail® would not be compatible with any of the detachable accessories for the Touring model.

In the co-pending application, the wall rack was designed to have a detachable windshield of Harley-Davidson®supported thereon, when the windshield was detached from the motorcycle, with the windshield having rearwardly extending hooks which could be secured to rods extending between a pair of vertically disposed brackets which were adapted to be secured to a vertically disposed wall or the like.

Recent models of motorcycle windshields of Harley-Davidson® employ a pair of clamping devices at each of the opposite sides of the windshield which are clamped onto the front fork members of the motorcycle. See for example, U.S. Pat. Nos. 6,736,441 and 6,808,219. The rack of the co-pending application was not well suited to support the new style(s) of Harley-Davidson® since the rods which extend between the side plates or brackets could not accommodate the rearwardly extending clamping devices of the windshield.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A motorcycle accessory rack is described which includes a first vertically disposed bracket having an inner end, an outer end, an upper end, a lower end, an inside surface and an outside surface and a second vertically disposed bracket horizontally spaced from the first bracket and which has an inner end, an outer end, an upper end, a lower end, an inside surface and an outside surface. A plurality of elongated and horizontally disposed rods having first and second ends are secured to the first and second brackets respectively and extend therebetween for supporting motorcycle accessories thereon. At least some of the rods are selectively adjustably secured to the brackets to permit the rods to be moved with respect to said brackets or to be moved to different slots or openings in the brackets to accommodate accessories from different motorcycle models. The accessory rack of the co-pending application also includes coat hangers and helmet hangers which are removable from the rack and which may be sold as optional equipment.

In the instant invention, a pair of horizontally spaced-apart and substantially upstanding supports or billets are mounted on a pair of vertically spaced-apart rods which extend horizontally between the side plates or brackets of the rack. The clamping devices of the windshield are selectively clamped onto the supports so that the windshield may be supported on the rack.

It is therefore principal object of the invention to provide an improved motorcycle accessory rack.

A further object of the invention is to provide a motorcycle accessory rack which permits it to support accessories from many different types of Harley Davidson® motorcycles.

Yet another object of the invention is to provide a motorcycle accessory rack having latching points which are adjustable to accommodate different accessories from different models of motorcycles.

A further object of the invention is to provide coat hangers and helmet hangers in association with the rack which are removable therefrom and which may be sold as optional equipment.

A further object of the invention is to provide a motorcycle rack which permits the newer style windshields of Harley-Davidson® to be supported thereon through the use of a pair of substantially vertically disposed and horizontally spaced-apart supports or billets which are mounted on a pair of vertically spaced rods which extend horizontally between the side plates or brackets of the rack.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
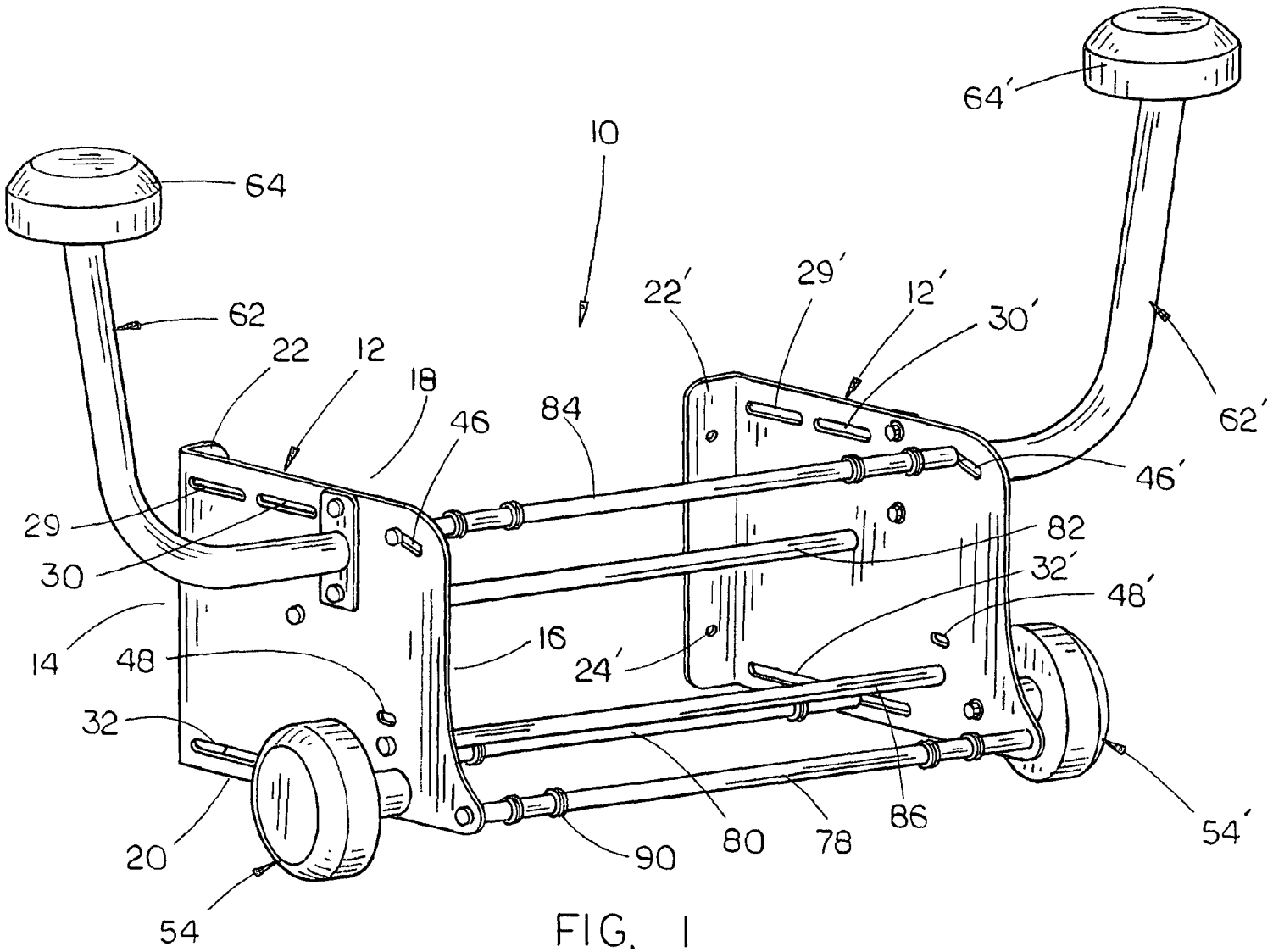
FIG. 1 is a front perspective view of the motorcycle accessory rack of the co-pending application.
Figure 2:
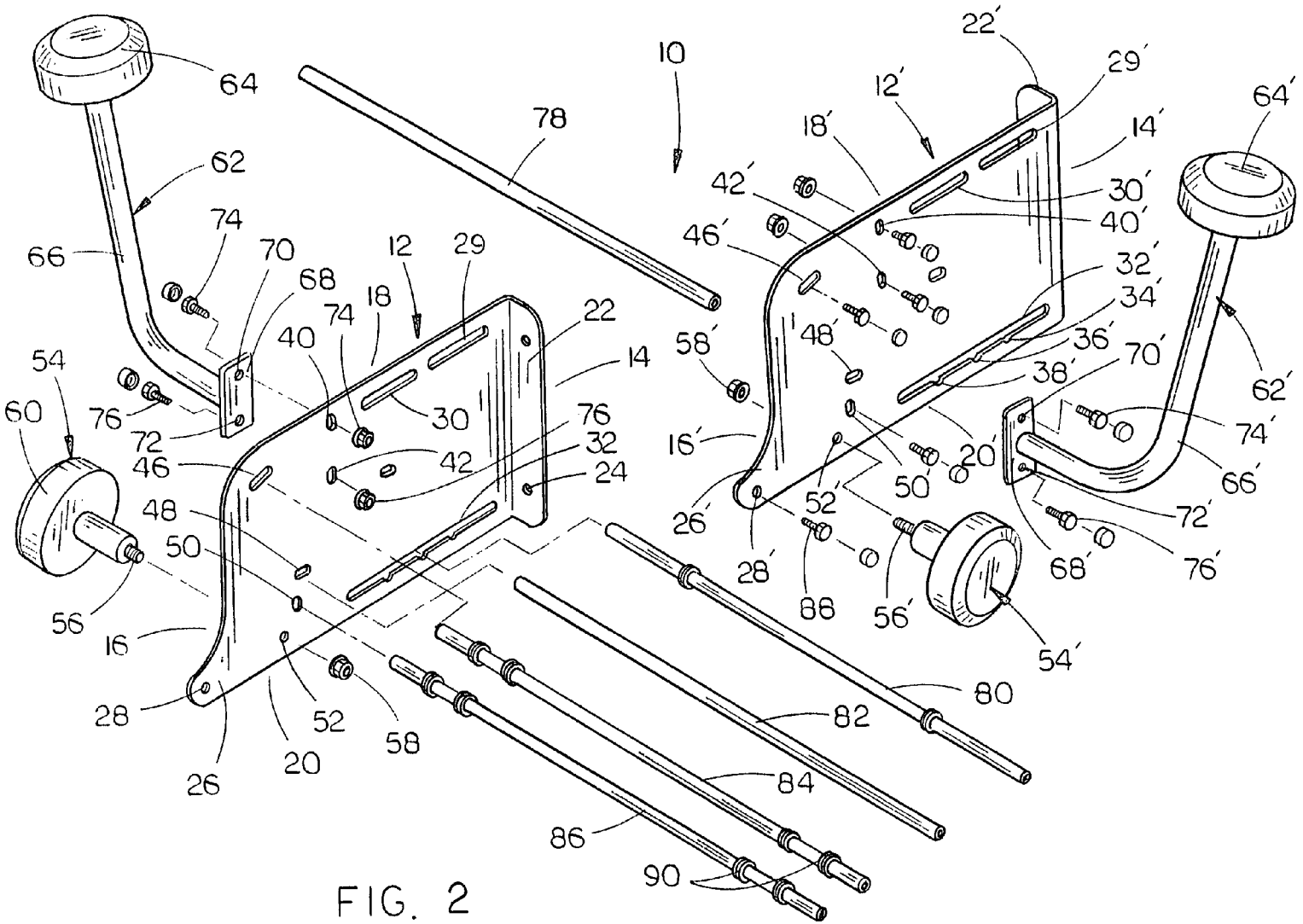
FIG. 2 is an exploded perspective view of the motorcycle accessory rack of the co-pending application.
Figure 3:
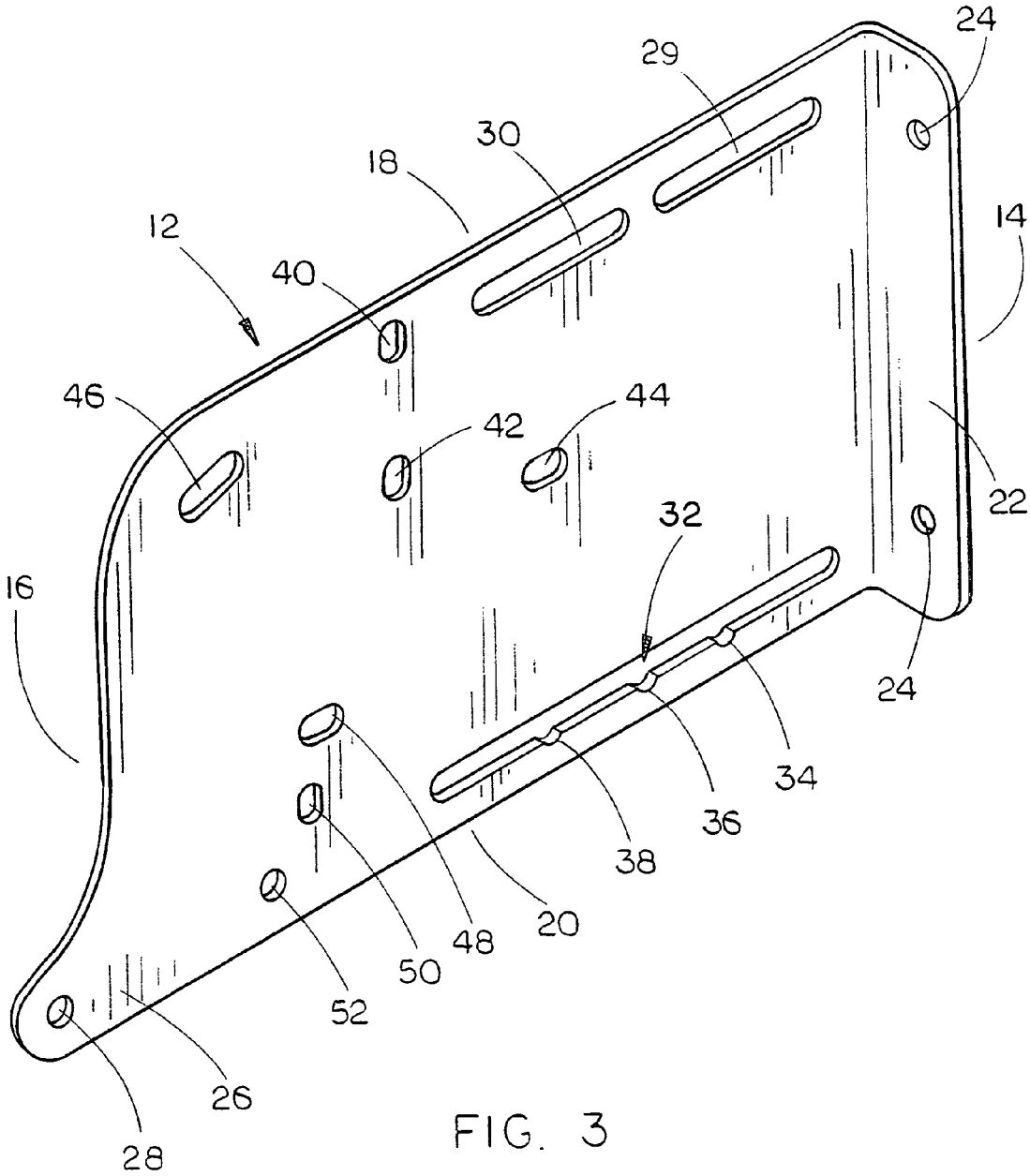
FIG. 3 is a front perspective view of one of the brackets of the rack of the co-pending application.
Figure 4:
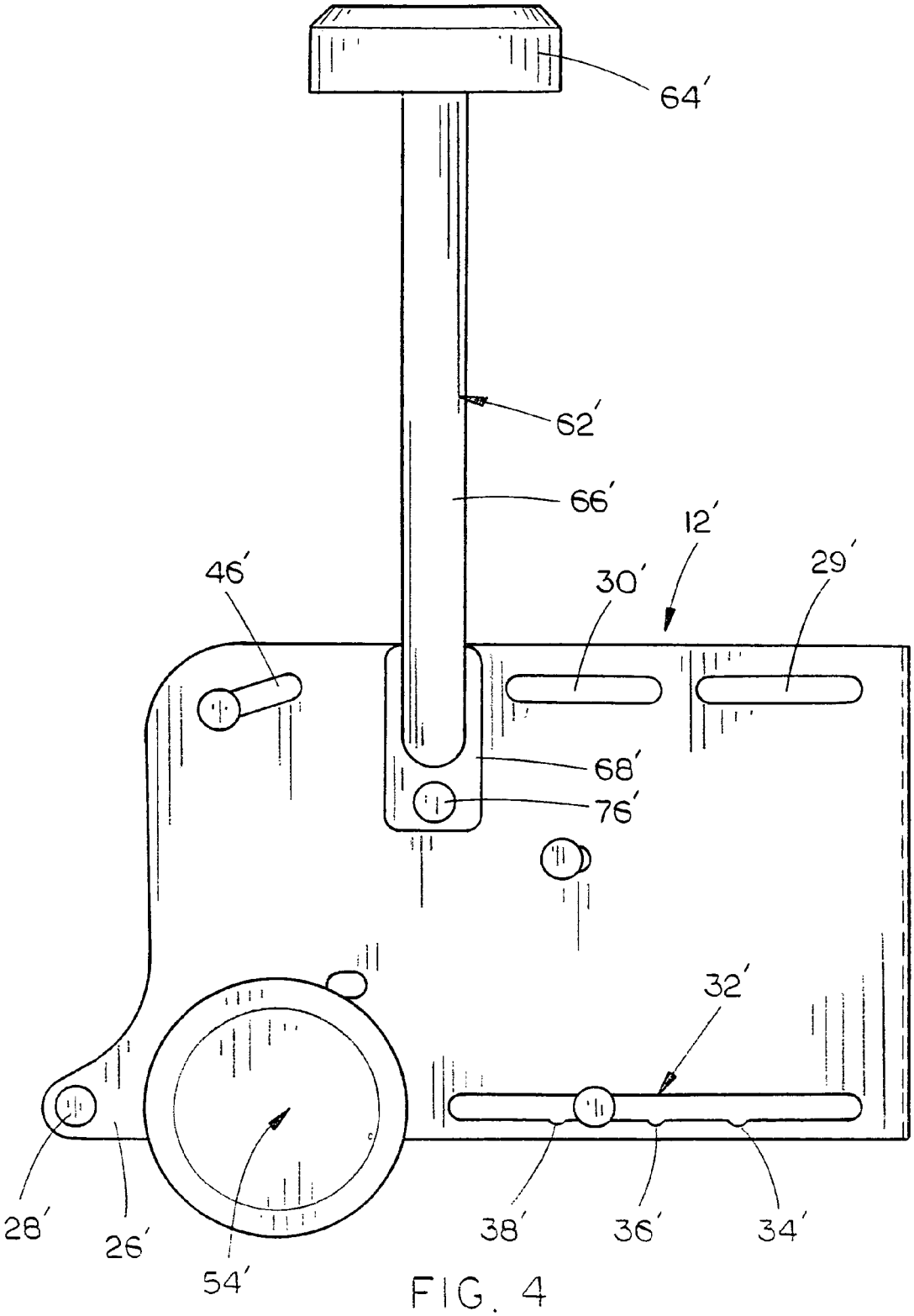
FIG. 4 is a side view of the other bracket of the rack of the co-pending application.
Figure 5:
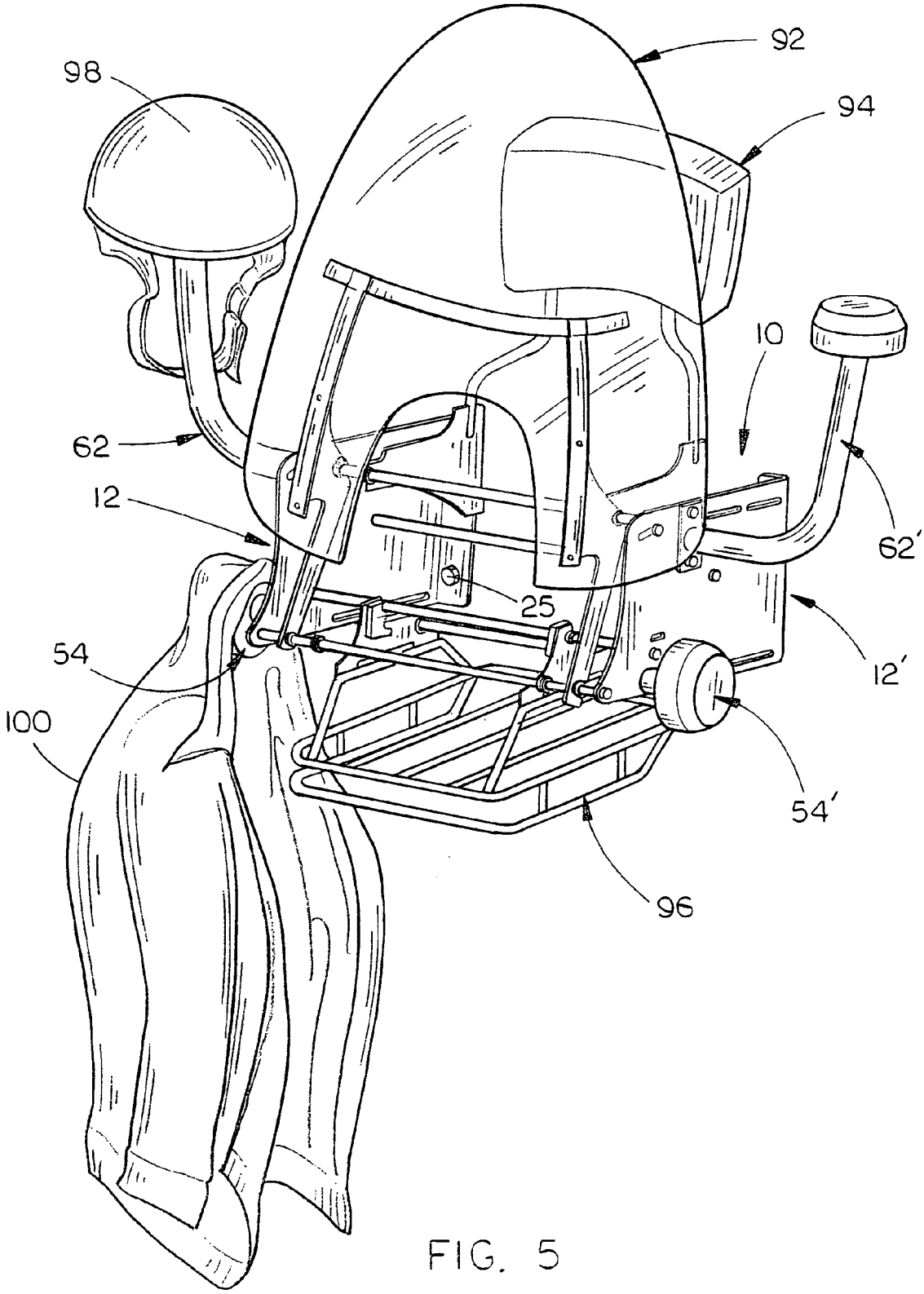
FIG. 5 is a perspective view illustrating various accessories being positioned on the accessory rack of the co-pending application.

With respect to FIGS. 1-5, the motorcycle accessory rack of the co-pending application is referred to generally by the reference numeral 10. As seen in FIG. 1, rack 10 includes horizontally spaced-apart side brackets 12 and 12' which are mirror images of one another. Bracket 12 includes an inner end 14, an outer end 16, an upper end 18 and a lower end 20. Mounting flange 22 is provided at inner end 14 and includes a plurality of openings 24 formed therein to enable screws 25 to be inserted therethrough to secure the bracket 12 to a vertically disposed wall or the like. As seen in FIG. 3, the forward end 16 of bracket 12 includes a protruding nose portion 26 having an opening 28 formed therein. Bracket 12 includes a pair of parallel slots 29 and 30 formed therein adjacent the upper end 18 thereof. Bracket 12 also includes an elongated slot 32 formed therein adjacent the lower end 20 thereof. Slot 32 is provided with spaced-apart, semi-circular recesses 34, 36 and 38.

A pair of vertically disposed slots 40 and 42 are formed in bracket 12 outwardly of slot 30. A horizontally disposed slot 44 is also formed in bracket 12 below and inwardly of slot 42. A diagonally extending slot 46 is formed in bracket 12 outwardly of slots 40 and 42. Horizontally disposed slot 48 is formed in bracket 12 above and outwardly of slot 32. A vertically disposed slot 50 is formed in bracket 12 below the outer end of slot 48. Opening 52 is formed in bracket 12 below and outwardly of slot 50.

The numeral 54 refers to a mushroom shaped, plastic hanger holder including a threaded bolt 56 extending therefrom which is adapted to extend through opening 52 and secured therein by nut 58 so that the head portion 60 of hanger 54 is positioned laterally outwardly of bracket 12. The numeral 62 refers to another hanger including a head portion 64, support arm 66 and flat plate 68 which has openings 70 and 72 formed therein. Bolts 74 and 76 are adapted to extend through openings 70 and 72 respectively so as to extend through slots 40 and 42 respectively and be retained therein by nuts 74 and 76 respectively so as to position hanger 62 outwardly of bracket 12 as seen in the drawings.

The numerals 78, 80, 82 84 and 86 refer to elongated support rods which have internally threaded openings at each end thereof adapted to threadably receive bolts 88. At least some of the support rods have plastic or rubber grommets 90 selectively movably positioned thereon as will be described in more detail hereinafter.

Bracket 12' includes an inner end 14', an outer end 16', an upper end 18' and a lower end 20'. Mounting flange 22' is provided at inner end 14' and includes a plurality of openings 24' formed therein to enable screws 25' to be inserted therethrough to secure the bracket 12' to a vertically disposed wall or the like. As seen in FIG. 3, the forward end 16' of bracket 12' includes a protruding nose portion 26' having an opening 28' formed therein. Bracket 12' includes a pair of parallel slots 29' and 30' formed therein adjacent the upper end 18' thereof. Bracket 12' also includes an elongated slot 32' formed therein adjacent the lower end 20' thereof. Slot 32' is provided with spaced-apart, semi-circular recesses 34', 36' and 38'.

A pair of vertically disposed slots 40' and 42' are formed in bracket 12' outwardly of slot 30'. A horizontally disposed slot 44' is also formed in bracket 12' below and inwardly of slot 42'. A diagonally extending slot 46' is formed in bracket 12' outwardly of slots 40' and 42'. Horizontally disposed slot 48' is formed in bracket 12' above and outwardly of slot 32'. A vertically disposed slot 50' is formed in bracket 12' below the outer end of slot 48'. Opening 52' is formed in bracket 12' below and outwardly of slot 50'.

The numeral 54' refers to a mushroom shaped, plastic hanger or holder including a threaded bolt 56' extending therefrom which is adapted to extend through opening 52' and secured therein by nut 58' so that the head portion 60' of hanger 54' is positioned laterally outwardly of bracket 12'. The numeral 62' refers to another hanger including a head portion 64', support arm 66' and flat plate 68' which has openings 70' and 72' formed therein. Bolts 74' and 76' are adapted to extend through openings 70' and 72' respectively so as to extend through slots 40' and 42' respectively and be retained therein by nuts 74' and 76' respectively so as to position hanger 62' outwardly of bracket 12' as seen in the drawings.

The numerals 78', 80', 82' 84' and 86' refer to elongated support rods which have internally threaded openings at each end thereof adapted to threadably receive bolts 88'. At least some of the support rods have plastic or rubber grommets 90' selectively movably positioned thereon as will be described in more detail hereinafter.

The rack 10 of FIGS. 1-5 may be assembled in various different ways. In other words, the rods 84 may be selectively adjustably mounted in their slots shown in FIGS. 1 and 2 or may be moved to different slots or openings. For example, one of the rods could be inserted in slots 29 and 29' or slots 30 and 30'. Rod 86 may be inserted in the slots 48 and 48' rather than the position shown in FIG. 1. The rod 80 may be placed in any position in the slots 32 and 32' or may be inserted in their slots.

The fact that the rods may adjustably moved in their slots or moved to different slots or openings enables the rods to be positioned so that various motorcycle accessories may be attached thereto. For example, in FIG. 5, a detachable windshield 92 is positioned on the rack 10 as are a back rest 94, rack 96, etc. A helmet 98 may be positioned on either or both of the hangers 62 and 62' and a jacket 100 may be hung on either or both of the hangers 54 and 54'. The rack 10 may also be used to support a rider backrest, or a tour pack.

The attachment points of the accessories which enable them to be removably secured to the motorcycle are connected or secured to the various rods or grommets thereon.

The adjustability of the rods permit them to be moved to a location between the brackets 12 and 12' so as to accommodate accessories from different models of motorcycles.

Thus, it can be seen that the invention of FIGS. 1-5 accomplishes at least all of its stated objectives in that it is able to accommodate accessories from different models of Harley-Davidson® motorcycles. Although the invention of FIGS. 1-5 has been described as particularly well suited for a Harley-Davidson® motorcycle, it is possible it could be used for other makes of motorcycles.

Figure 9:
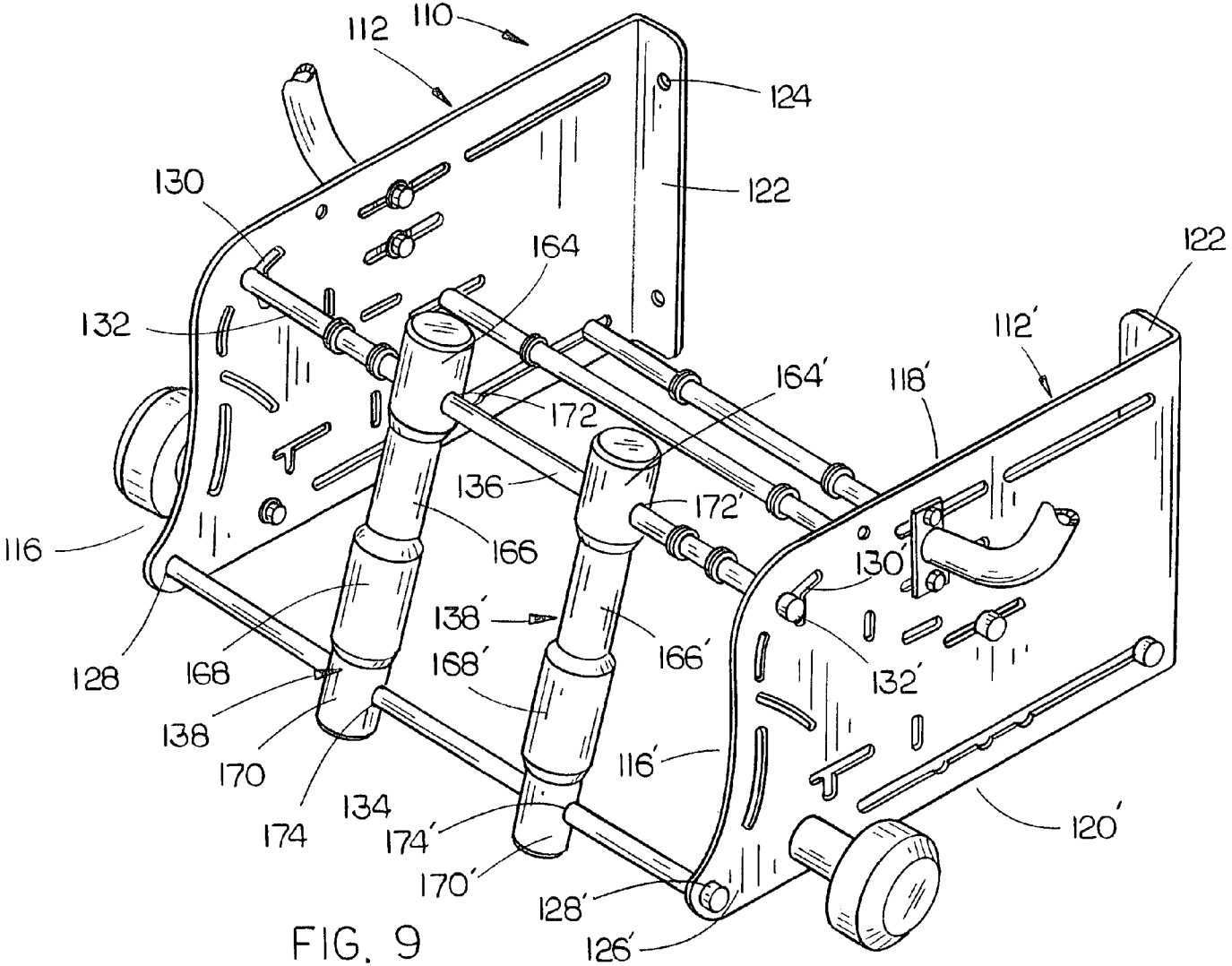
FIG. 9 is a perspective view of the rack of this invention having a pair of spaced-apart supports mounted thereon.
Figure 10:
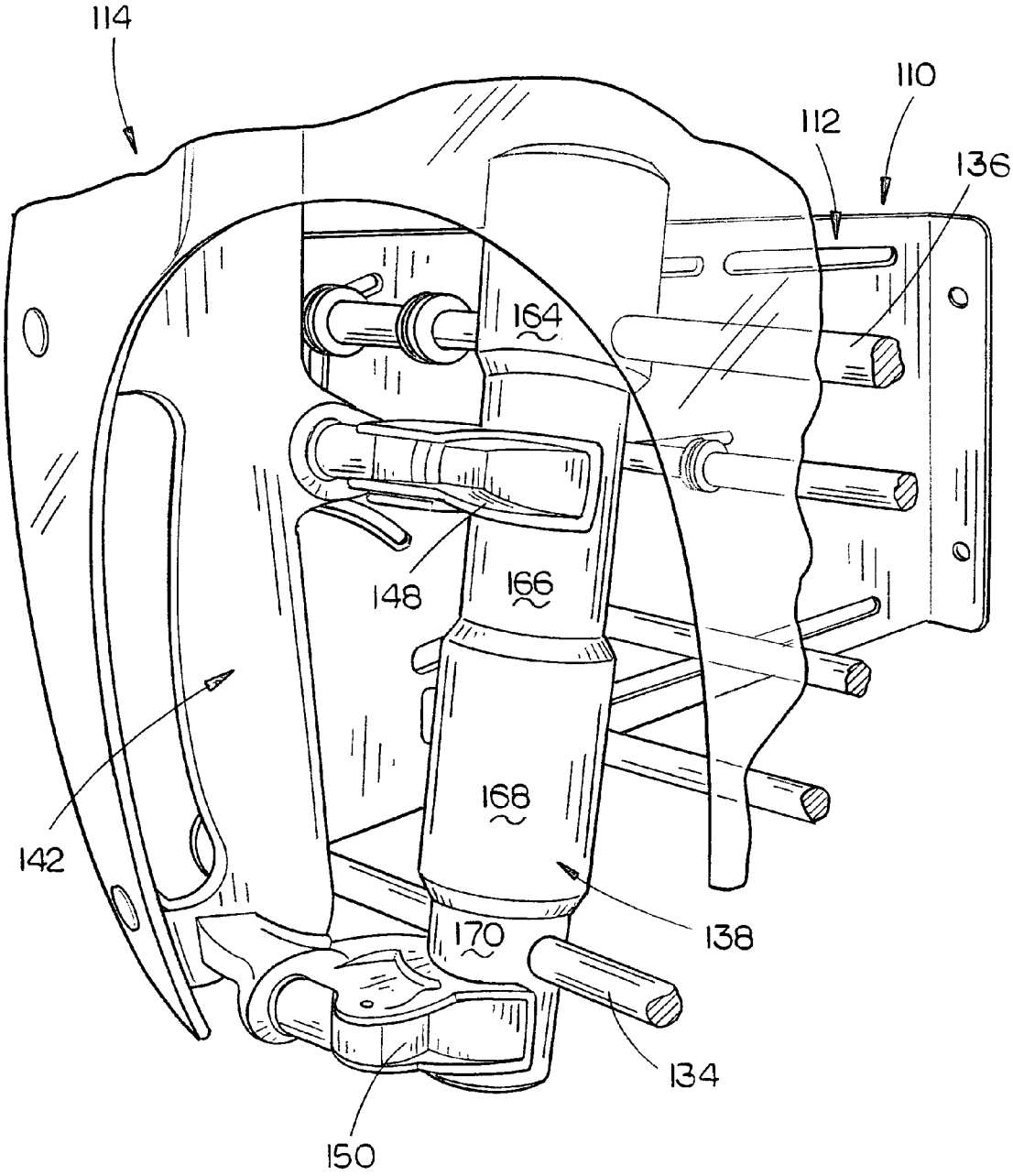
FIG. 10 is a partial perspective view of the rack of this invention illustrating the manner in which the windshield is mounted on the rack.
Figure 11:
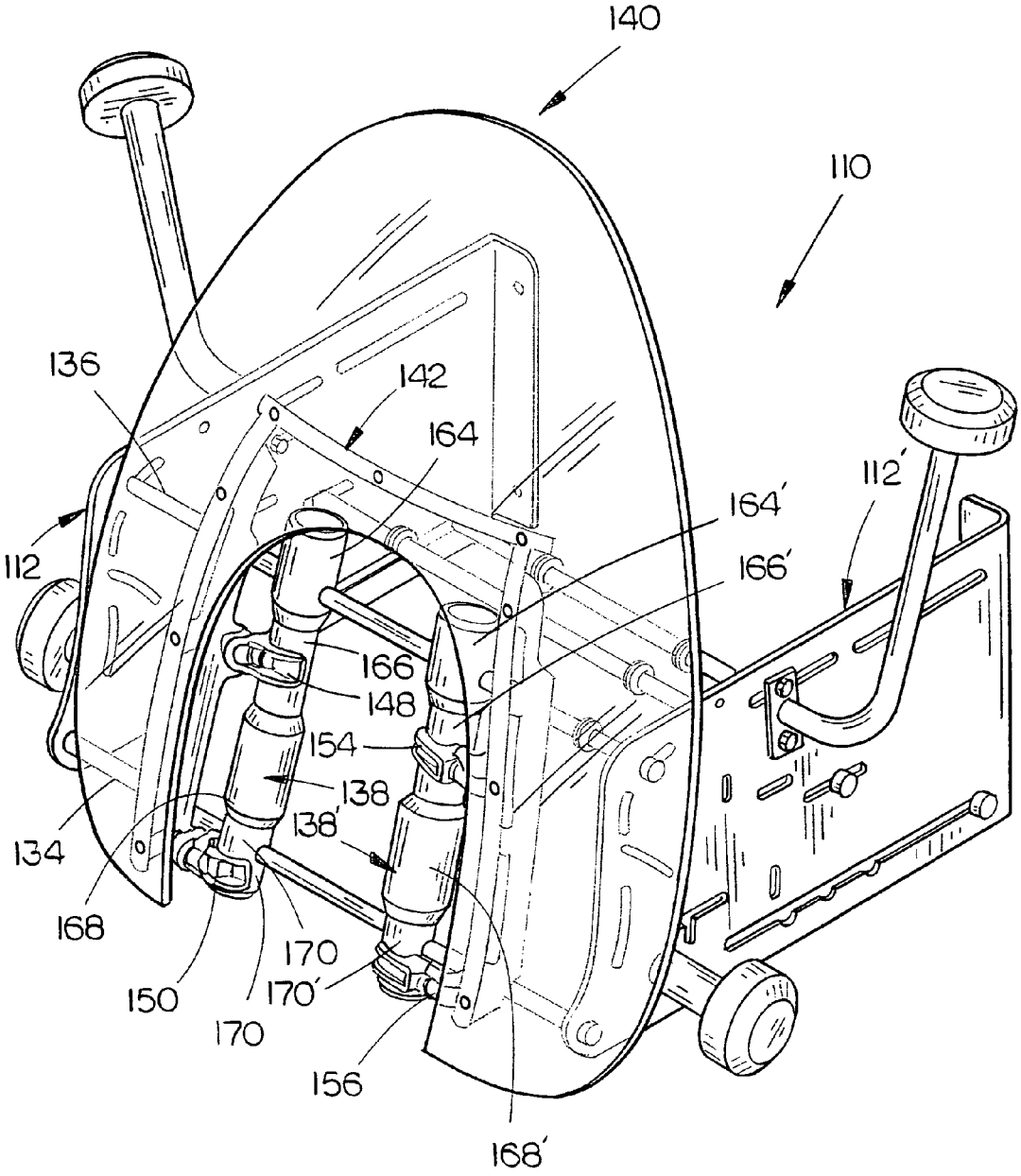
FIG. 11 is a perspective view illustrating a windshield supported on the rack.

In FIGS. 9-11, a slightly modified motorcycle rack 110 from that of FIGS. 1-5, is illustrated. The rack 110 itself is substantially identical to rack 10 except for a somewhat different arrangement of the openings or slots formed in the brackets 112 and 112'. Since the instant invention only relates to a different way of supporting a motorcycle windshield 114 on the rack 110, only these slots or openings in brackets 112 and 112', which form a part of the instant invention, will be described in detail.

Bracket 112 includes an inner end 114, and outer end 116, an upper end 118 and a lower end 120. Mounting flange 122 is provided at inner end 114 for securing the bracket 112 to a vertically disposed wall or the like. Flange 122 is provided with openings 124 formed therein. As seen, the lower outer end 116 of bracket 112 includes a protruding nose portion 126 having an opening 128 formed therein. The upper outer end of bracket 112 includes a diagonally extending slot 130 having a slot 132 extending downwardly therefrom.

Bracket 112' includes an inner end 114', and outer end 116', an upper end 118' and a lower end 120'. Mounting flange 122' is provided at inner end 114' for securing the bracket 112' to a vertically disposed wall or the like. As seen, the lower outer end 116' of bracket 112' includes a protruding nose portion 126' having an opening 128' formed therein. The upper outer end of bracket 112' includes a diagonally extending slot 130' having a slot 132' extending downwardly therefrom.

The numeral 134 refers to an elongated support rod, having an internally threaded opening at each end thereof, which extends between openings 128 and 128' with bolts extending through openings 128 and 128' into the threaded openings in the ends of the support rod 134 in the same manner as in the co-pending application.

The numeral 136 refers to an elongated support rod, having an internally threaded opening at each end thereof, which extends between slots 130 and 130' with bolts extending through slots 130 and 130' into the threaded openings in the ends of support rod 136. Support rod 136 may be adjustably positioned with respect to slots 130 and 130' as required or in the slots 132 and 132'.

Various other slots and openings are formed in brackets 112 and 112' for receiving bolts, hangers, etc., in the same manner as in rack 10.

The numerals 138 and 138' refer to elongated, generally cylindrical support members which are identical to one another. Therefore, only support 138 will be described in detail hereinafter with "'" being utilized to indicate identical structure with respect to support member 138'.

Figure 6:
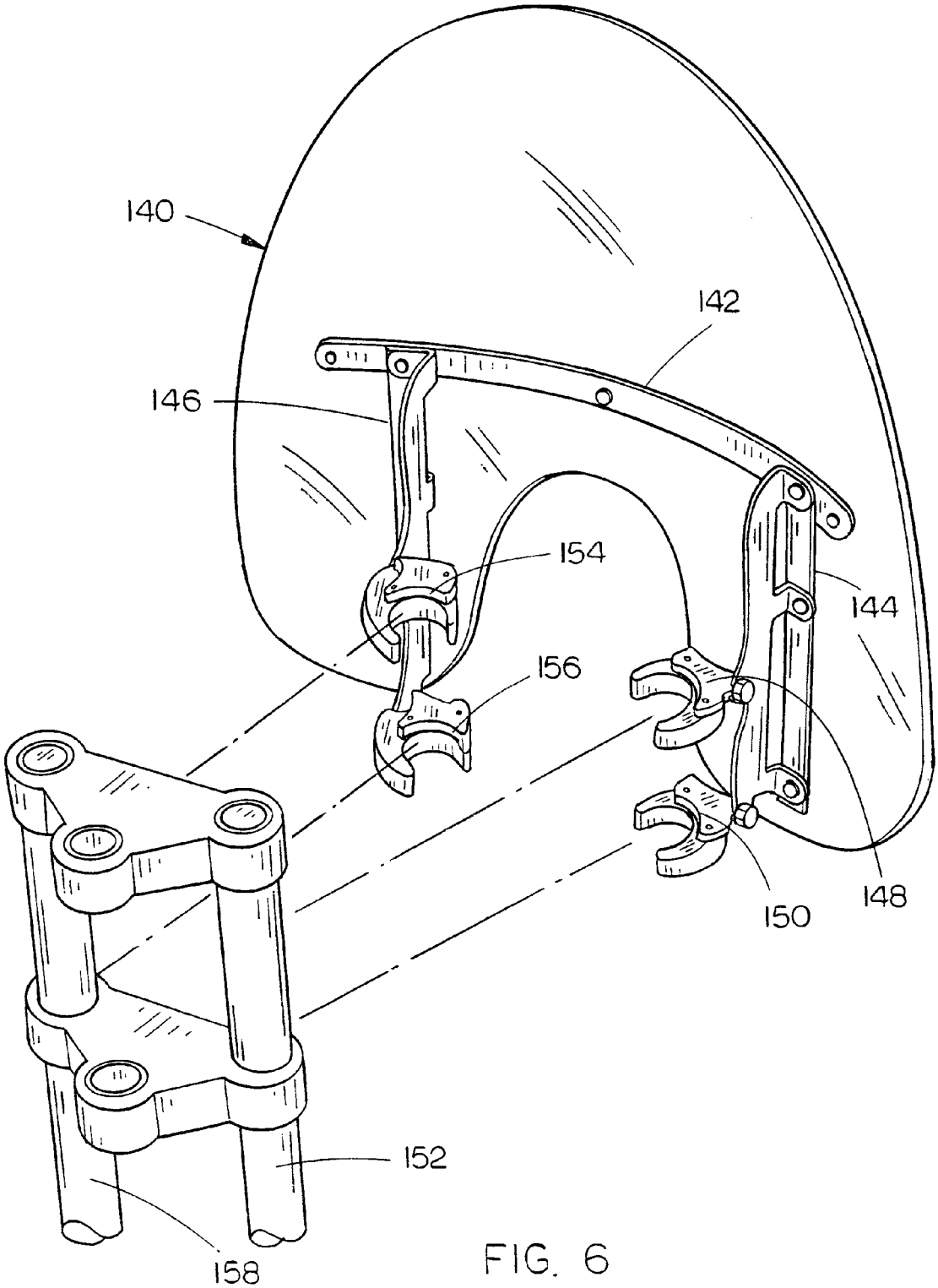
FIG. 6 is a perspective view of a Harley-Davidson® motorcycle windshield and its relationship with respect to a motorcycle fork.
Figure 7:
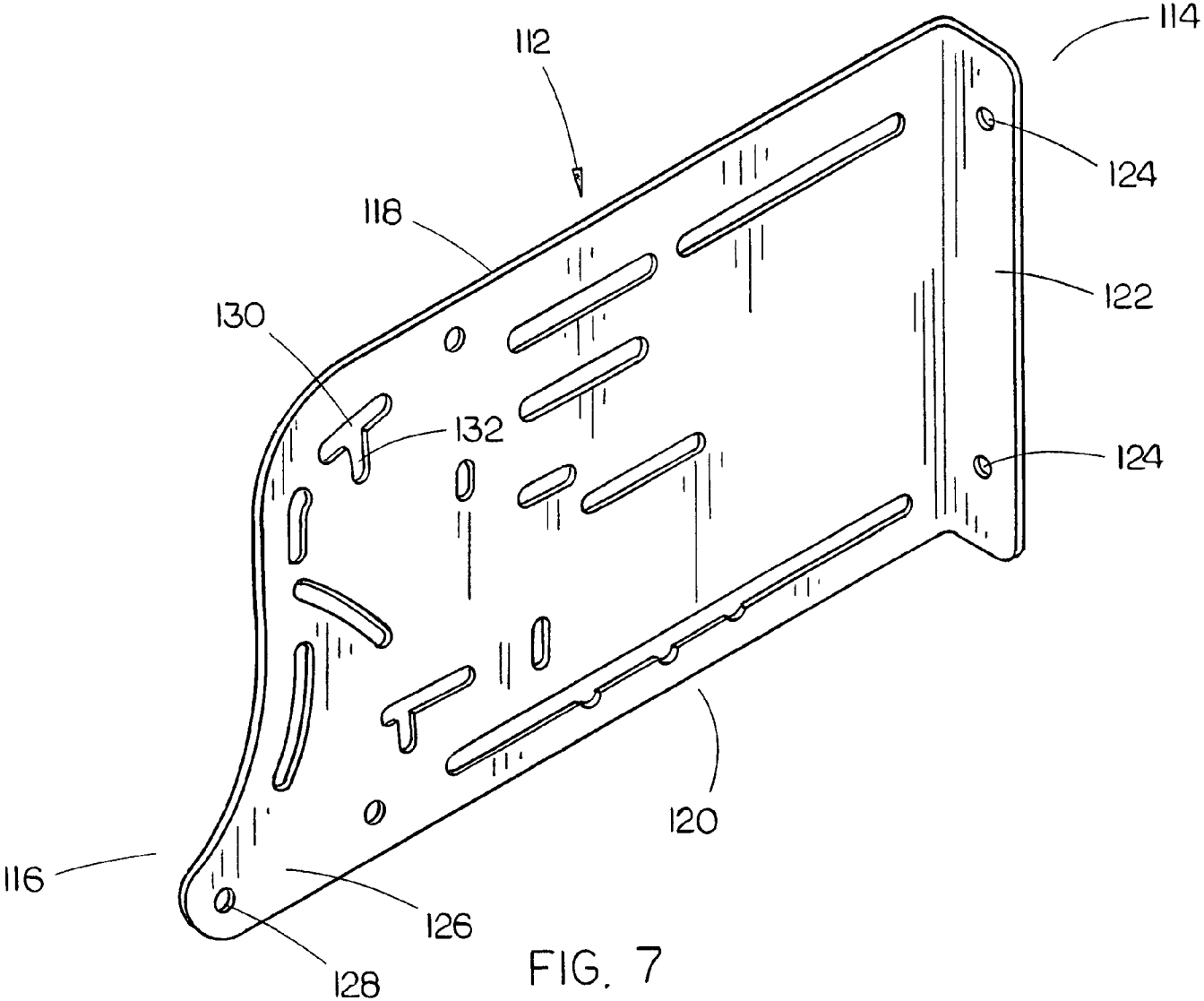
FIG. 7 is a perspective view of one of the side plates or brackets of the rack of this invention.
Figure 8:
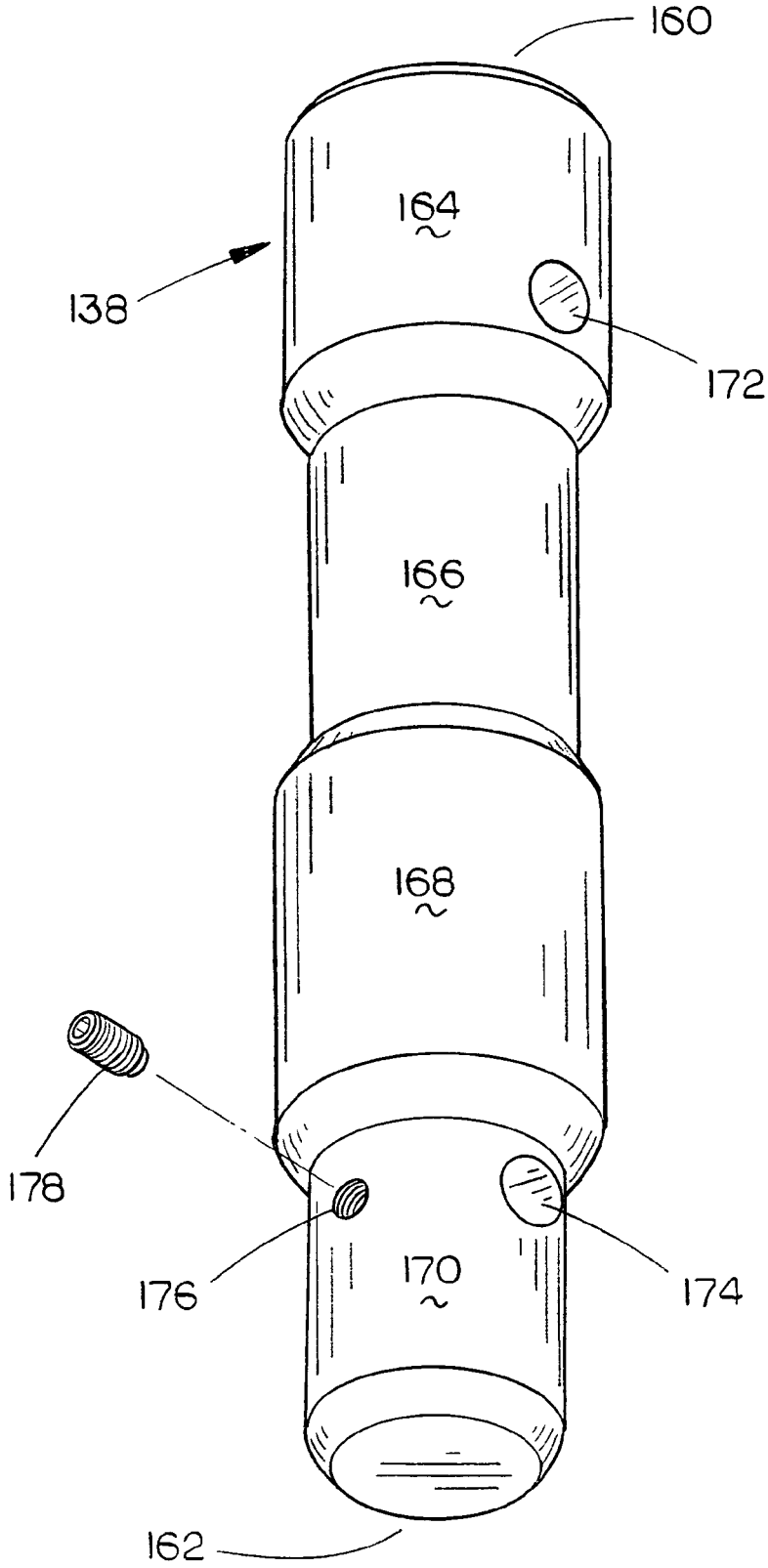
FIG. 8 is a perspective view of one of the supports or billets of the rack of this invention.

As stated hereinabove, the rack 10 of FIGS. 1-5 is ideally suited to support older style windshields. However, the newer style windshields of Harley-Davidson® are secured to the motorcycle in a different manner than the older models. FIG. 6 illustrates a newer style windshield of Harley-Davidson® which is referred to by the reference numeral 140. Windshield 140 includes a frame 142 having opposite sides 144 and 146. A first pair of clamps 148 and 150 are secured to the frame 142 and extend rearwardly therefrom for clamping engagement with fork member 152. A second pair of clamps 154 and 156 are secured to the frame 142 and extend rearwardly therefrom for clamping engagement with fork member 158 to support the windshield 140 on the motorcycle. When the clamps 148, 150, 154 & 156 are released from the fork members 152 and 158, as seen in FIG. 6, the windshield 140 may be removed therefrom for storage.

The rack 110 of FIGS. 7-11 is adapted to permit the windshield 140 to be supported on the rack 110 as will be described in more detail hereinafter.

Support 138 is generally cylindrical and includes an upper end 160 and a lower end 162. Support 138 is provided with four cylindrical sections 164, 166, 168 and 170. Sections 164 and 168 have the same diameters as one another. Sections 166 and 168 have the same diameters with those diameters being less than the diameters of sections 164 and 168.

Section 164 has a bore 172 extending therethrough. Sections 170 also has a bore 174 extending therethrough which is parallel to bore 172. A tapped bore 176 extends into section 170 transversely to bore 174 and insects bore 170. Screw 178 is threadably insected into bore 176 with the inner end of screw 178 engaging the support rod 134 extending through bore 174.

Prior to rods 134 and 136 being secured to brackets 112 and 112', the rod 136 is extended through the bores 172 and 172' in supports 138 and 138' respectively and rod 134 is extended through bores 174 and 174' in supports 138 and 138' respectively. The rods 134 and 136 are then secured to the brackets 112 and 112'. When the supports 138 and 138' are properly positioned on the rods 134 and 136, the screw 176 is threadably moved into engagement with rod 134 in bore 174 to lock the support 138 in position. The same locking step is performed on support 138.

The clamps 148 and 150 of the windshield 140 are then clamped onto the sections 166 and 170 of support 138. The clamps 154 and 156 are then clamped onto the sections 166' and 170' of support 138'. The windshield 140 is then held in position on the rack 110 as seen in FIG. 11. In certain styles of Harley-Davidson® motorcycle windshields, the clamps thereof may be larger than that shown in the drawings. In that case, the clamps 148 and 150 may be clamped onto the larger sections 164 and 168 of support 138 and clamps 154 and 156 may be clamped onto the larger sections 164' and 168' of support 138'.

Thus, it can be seen that a unique rack 110 has been provided for supporting the newer style motorcycle windshield which are clamped onto the forks of the motorcycle. It can therefore be seen that the rack accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A motorcycle accessory rack capable of selectively removably supporting different models of motorcycle windshields thereon with at least one model of the windshields having first and second sides and at least a pair of horizontally spaced-apart clamps secured thereto at each of said first and second sides which are used to releasably clamp the windshield onto a motorcycle, comprising:

a first vertically disposed bracket having an inner end, an outer end, an upper end, a lower end, an inside surface and an outside surface;

a second vertically disposed bracket horizontally spaced from said first bracket and having an inner end, an outer end, an upper end, a lower end, an inside surface and an outside surface;

said inner ends of said brackets adapted to be secured to a vertically disposed wall or the like;

at least first and second elongated horizontally disposed and vertically spaced rods having first and second ends secured to said first and second brackets respectively and extending therebetween adjacent said outer ends thereof;

a first, generally upright, support secured to said first and second rods and extending therebetween inwardly of said first ends thereof;

a second, generally upright, support secured to said first and second rods and extending therebetween inwardly of said second ends thereof;

each of said first and second supports having at least a first and a second cylindrical section wherein said second cylindrical section is smaller in diameter than said first cylindrical section and each of said cylindrical sections is capable of supporting a clamp secured thereto to permit different models of windshields to be selectively supported on the accessory rack.

2. The motorcycle accessory rack of claim 1 wherein said first and second supports are selectively horizontally adjustable with respect to said rods.

3. The motorcycle accessory rack of claim 1 wherein said first and second supports are selectively slidably mounted on said rods.

4. The motorcycle accessory rack of claim 3 wherein said rods extend through said first and second supports.

5. The motorcycle accessory rack of claim 4 wherein each of said first and second supports have a set screw extending thereinto for engagement with one of said rods to selectively maintain the support in position on the rods.

6. The motorcycle accessory rack of claim 1 wherein each of said first and second supports are generally cylindrical in shape.

7. The motorcycle accessory rack of claim 1 wherein each of said first and second supports have at least a third and a fourth cylindrical sections wherein the first and third sections have the same diameter as one another and wherein said second and fourth sections have the same diameters but which are smaller in diameter than said first and third sections.

* * * * *